US011779803B2

(12) United States Patent
Xiang et al.

(10) Patent No.: US 11,779,803 B2
(45) Date of Patent: Oct. 10, 2023

(54) FITNESS BIKE

(71) Applicant: Loctek Ergonomic Technology Corp., Zhejiang (CN)

(72) Inventors: Lehong Xiang, Zhejiang (CN); Dajiang Zhao, Zhejiang (CN)

(73) Assignee: LOCTEK ERGONOMIC TECHNOLOGY CORP., Ningbo (CN)

( * ) Notice: Subject to any disclaimer, the term of this patent is extended or adjusted under 35 U.S.C. 154(b) by 0 days.

(21) Appl. No.: 17/504,525

(22) Filed: Oct. 19, 2021

(65) Prior Publication Data

US 2022/0226693 A1 Jul. 21, 2022

(30) Foreign Application Priority Data

Jan. 20, 2021 (CN) ..... 202110074759.4

(51) Int. Cl.
*A63B 22/06* (2006.01)

(52) U.S. Cl.
CPC .. *A63B 22/0605* (2013.01); *A63B 2022/0641* (2013.01)

(58) Field of Classification Search
CPC ..... A63B 22/0012; A63B 21/023; A63B 21/0442; A63B 21/4034; A63B 21/4035; A63B 22/0005; A63B 22/0605; A63B 24/0062; A63B 71/0622; A63B 2024/0093; A63B 2071/0666; A63B 2220/51; A63B 21/005; A63B 21/008; A63B 21/015; A63B 2071/0638; A63B 2071/0655; A63B 2071/0675; A63B 2220/10; A63B 2220/16; A63B 2220/40; A63B 2220/803; A63B 2225/20; A63B 2230/06; A63B 2230/42
See application file for complete search history.

(56) References Cited

U.S. PATENT DOCUMENTS

| | | | | |
|---|---|---|---|---|
| 2018/0338606 | A1* | 11/2018 | Xiang | A47B 21/02 |
| 2020/0238130 | A1* | 7/2020 | Silcock | A63B 22/0005 |
| 2021/0060380 | A1* | 3/2021 | Hawkins, III | A63B 22/0605 |
| 2021/0205650 | A1* | 7/2021 | Wang | A63B 21/0052 |
| 2022/0266088 | A1* | 8/2022 | Hansen | A63B 21/225 |

FOREIGN PATENT DOCUMENTS

| | | | | |
|---|---|---|---|---|
| CN | 108260981 A | * | 3/2018 | A63C 7/00 |
| CN | 211245373 U | * | 10/2019 | A63B 22/06 |

* cited by examiner

*Primary Examiner* — Andrew S Lo
*Assistant Examiner* — Andrew M Kobylarz
(74) *Attorney, Agent, or Firm* — Pearne & Gordon LLP

(57) ABSTRACT

A fitness bike is provided which comprises a support skeleton which comprising a triangular frame which is formed by a connection rod as a transverse rod connecting a front support leg and a rear support leg, an oblique bar of the front support leg, an oblique rod comprising a support box and a connection block of a pedaling device, and a seat column as a vertical rod; a lower end of the oblique bar is fixed on a middle of a horizontal rod of the front support leg, a rear end of the connection rod is fixed at a front side of a middle of a V-shaped rod forming the rear support leg and having an opening facing backward, and a seat support device is mounted on the top of the seat column. The structure of the fitness bike provided is simple, compact, stable, and occupies less space.

12 Claims, 13 Drawing Sheets

FITNESS BIKE

CROSS REFERENCE TO THE RELATED APPLICATIONS

This application is based upon and claims priority to Chinese Patent Application No. 202110074759.4, filed on Jan. 20, 2021, the entire contents of which are incorporated herein by reference.

TECHNICAL FIELD

The present invention relates to the technical field of fitness appliances and in particular to a fitness bike.

BACKGROUND

As people have new understanding and new concept for fitness, work and study, it is possible for the people to do exercises while working or studying. For example, it gradually becomes a common practice for people to do exercises by stepping on a pedaling device while sitting on a seat of a fitness bike when working or studying.

In the prior art, there are various types of fitness bikes with different structures. In an actual use, the fitness bikes in the prior art still have the following shortcomings: 1. some entire support skeletons of the fitness bikes are complex in structure, and large in volume and occupation area, some are excessively bulky and high in material costs, and some are slightly thin and poor in reliability and durability. 2. Some leg-foot support structures of the fitness bikes are complex in structure and high in material costs, some are thin and poor in durability; support legs are usually of fixed structure and a distance between a front support leg and a rear support leg cannot be adjusted; a foot pad structure of the support leg is complex in structure, poor in support reliability and inconvenient to mount or dismount. 3. Some support devices of seats of the fitness bikes are rugged in structure but slightly complex in structure, some are simple in structure but inconvenient to adjust, some are convenient to adjust but poor in reliability. Therefore, it is difficult to have a good balance of sufficient reliability, simple structure and convenient adjustment, requiring improvements. Further, due to functional and structural limitations of the fitness bikes, the seats of the existing fitness bikes cannot be used as ordinary chairs individually. 4. Some housing structures of the fitness bikes are insufficient in reliability and large in external volume and occupation space, some are complex in assembly structure and inconvenient to mount or dismount, some are poor in external aesthetics, giving poor psychological experiences to the exercisers. 5. Knob assemblies of resistance adjustment devices in the prior art are large in volume and occupation space, and protrude out of surfaces of the housings, and are easily damaged due to collision. The fitness bikes in the prior art are basically provided with a handle device which has a handle or used as a handle desk board, the knob assemblies are all mounted on an upper end of a handle or desk board column, the knob assemblies of some fitness bikes without a handle or a desk board are also mounted on an upper end of a seat column. The common disadvantages are as follows: a longer distance between the knob assembly and a magnetic resistance sheet, many folding points, low adjustment flexibility and low adjustment accuracy in an actual operation process.

SUMMARY

The technical problem to be solved by the present invention is to provide a fitness bike with an entire support skeleton being structurally simple, compact, reliable and occupying less area.

The technical solution of the present invention is to provide a fitness bike comprising a support skeleton. The support skeleton comprises a triangular frame which is formed by a connection rod as a transverse rod connecting a front support leg and a rear support leg, an oblique bar of the front support leg, an oblique rod comprising a support box and a connection block of a pedaling device, and a seat column as a vertical rod, which are connected with each other. A lower end of the oblique bar is fixed on a middle of a horizontal rod of the front support leg, a rear end of the connection rod is fixed at a front side of a middle of a V-shaped rod forming the rear support leg and having an opening facing backward, and a seat support device is mounted on the top of the seat column.

With the above structure, the fitness bike of the present invention has the following advantages: the support leg, the support box and connection block of the pedaling device and the seat column form a stable and reliable triangular frame which becomes a core support of the entire skeleton. The entire support skeleton structure of the fitness bike in the present invention is simple, compact, small in volume and occupation area, and occupies less space, and the structure is sturdy, stable, reliable and durable.

Furthermore, the horizontal rod and the oblique bar of the front support leg, the connection rod, and the V-shaped rod with an opening facing backward are all round pipes: the horizontal rod is a horizontal straight pipe, the oblique bar is an oblique pipe, the connection rod comprises a connection pipe, and the V-shaped rod is a V-shaped pipe; an adjustment structure for adjusting a position of the V-shaped pipe relative to the horizontal straight pipe back and forth is disposed on the connection rod: a middle sleeve is inserted into a rear end of the connection pipe, a slide pipe is inserted into the middle sleeve, a plurality of first thread holes for tightening first screws are disposed at the bottom of the rear end of the connection pipe, and a plurality of first through holes for inserting the first screws are disposed at the bottom of the middle sleeve; the slide pipe is a stepped pipe with its rear end being a large pipe, a rear end surface of the large pipe is an arc-shaped groove matched in shape with the front side of the middle of the V-shaped pipe, a front end of the slide pipe is a small pipe having a front end plate, an axial long groove is disposed at the bottom of the small pipe, and a groove top surface of the axial long groove is a plane to be abutted against by the first screws. After disposal of the above structure, all of the rods will be round pipes, which can not only ensure good mechanical property and supporting strength of the support legs but also save material costs. The adjustment structure for adjusting the position of the V-shaped pipe relative to the housing of the bike body back and forth enables the support legs to receive more balanced and reasonable forces, ensuring better balance, stability and sturdiness of the fitness bike. Further, by loosening second screws, the adjustment structure may allow the slide pipe to be slid to adjust the position of the V-shaped pipe relative to the housing of the bike body back and forth. Therefore, the structure is simple and easily operable and can realize reliable and firm connection after locking up.

Furthermore, both ends of the horizontal straight pipe each have one foot pad sleeve, and both ends of the V-shaped pipe each have one foot pad sleeve; the foot pad sleeve is a three-way structure, in which one way facing inwardly is an inner sleeve sleeved onto the end of the horizontal straight pipe, one way facing outwardly is an outer sleeve into which an outer end cover is sleeved detachably, and one way facing downwardly is a lower sleeve in which a central pipe connected with a plurality of connection ribs is disposed. A second thread hole is disposed in the central pipe and a second screw for adjusting a height is screwed into the second thread hole. A sleeve pad for being attached to the ground is fixed on a large head of the second screw. After disposal of the above structure, the connection structure and the height adjustment structure of the foot pad sleeve are relatively simple, and can save material costs on the precondition of ensuring the strength of the foot pad sleeve. With the application of the sleeve pads, the foot pad sleeve can realize height adjustment function and increase a contact area between the bottom surface of the screw and the ground, thus realizing better balance, stability and sturdiness of the fitness bike.

Further, the end of the horizontal straight pipe and the V-shaped pipe sleeved with the inner sleeve has a downwardly-facing L-shaped gap, a horizontal plane support block for supporting the L-shaped gap is disposed in the inner sleeve, one third through hole for inserting a third screw is disposed on a bottom wall of the inner sleeve, and a third thread hole for screwing the third screw is disposed on the top wall of the L-shaped gap of the horizontal straight pipe and the V-shaped pipe. After disposal of the above structure, the connection structure of the inner sleeve of the foot pad sleeve and the end of the support leg is designed skillfully. The connection structure is made simple, reliable and sturdy due to the structure of the L-shaped gap coupled with the screws and the thread holes.

Furthermore, the seat support device has the following structure: the top of the seat column is connected with a support frame having two slide sleeves, front and rear ends of two slide rods slidably mated in the respective slide sleeves are connected to a seat cushion support plate, a rocking handle toggling device is mounted at the front end of the seat cushion support plate, a toggling block of the rocking handle toggling device has a locating column, an elongated limiting block extending back and forth is disposed on the support frame, a plurality of locating holes extending back and force and receiving the locating column are disposed on the elongated limiting block, and a locking torsional spring for locking the locating column in one locating hole is disposed on the rocking handle toggling device. With the disposal of the above structure, the structure of the support device is simplified: the top of the seat column is connected with the support frame having two slide sleeves, and the front and rear ends of two slide rods slidable mated in respective slide sleeves are connected with the seat cushion support plate, and therefore the structure is clear and simple. At the same time, the structure is very sturdy: the two slide sleeves are fixed on the support frame, the seat cushion support plate is fixed on the two ends of the slide rods slidably mated in the respective slide sleeves. In this way, force balancing and reasonable force distribution can be realized and the structure is made sturdy and stable. The back-and-forth movement can be easily performed: the rocking handle toggling device is toggled to dislocate the locating column from the locating hole, and at the same time, the seat cushion support plate is moved to drive the seat to a desired position, and then the rocking handle toggling device is released to complete locking. Therefore, the adjustment is very simple, convenient, and fast, and good balancing of simple structure, structure sturdiness and convenient adjustment is realized.

Furthermore, the rear ends of the two slide rods have a connection base for connecting with a backrest fixing frame, and a backrest is connected with to the backrest fixing frame. The seat cushion support plate is rectangular, and a rear side of the seat cushion support plate is thread-connected with the connection base. A downwardly-curled edge at a front side of the seat cushion support plate is thread-connected with the front ends of the two slide rods. The seat cushion support plate is thread-connected with a rigid bottom plate of a seat cushion. After the disposal of the above structure, under the condition of a given thickness of the steel plate, that is, under the precondition of not increasing the thickness of the steel plate significantly, the downwardly-curled edges of back and front sides, i.e. the curled plates, enable the seat cushion support plate to have better mechanical property and more sturdy structure. Further, the backrest fixing frame with backrest is integrally fixed with the seat cushion support plate through the connection base, realizing better integrity. In this case, the structural sturdiness is better, the bearing capacity is higher and the service life is longer.

Furthermore, the seat column is the sole upward column of the fitness bike without a handle device, and the seat column comprises a seat support pipe; the seat support device further comprises a seat lifting structure: an inner pipe is sleeved slidably into the seat support pipe, the top of the inner pipe is connected with the support frame, the inner pipe is connected with a piston rod free end of a lockable gas spring located inside the inner pipe, a cylinder of the lockable gas spring is placed in the seat support pipe and connected with the seat support pipe, and a control valve of the lockable gas spring can be connected to control the lockable gas spring to be released and further lift, or lower or lock up a toggling assembly of the seat mounted on the support frame. After the disposal of the above structure, the fitness bike is not provided with a handle device, that is, not provided with a handle or a desk board as a handle. In this way, an exerciser may work or study while pedaling, that is, the hand of the exercise may be placed on the office desk. In a non-exercise time, the seat with the backrest can be adjusted to the front position through a front-back adjustment device, and at the same time, the seat can be adjusted to a height of an ordinary chair and used as an ordinary chair. Therefore, the use function of the fitness bike is increased and the user efficiency of the fitness bike is improved.

Further, a fitness bike housing structure comprises a left body housing, a right body housing, an upper cover, a left crank housing, and a right crank housing; rear ends of the left body housing and the right body housing embrace the seat column of the fitness bike, front ends of the left body housing and the right body housing embrace the oblique pipe of the front support leg of the fitness bike, the middle bottoms of the left body housing and the right body housing embrace the connection pipe of the fitness bike, and the left body housing and the right body housing are detachably connected. The seat column is inserted through a first column through hole of a rear end of the upper cover, the bottom of the front end of the upper cover is abutted against a stepped surface of a lower portion of a front end of the connected left and right body housings, and both sides of the upper cover are detachably connected with the left body housing and the right body housing; the crank housing is detachably connected with a connection plate of a crank and rotatably mated with a center hole of the body housing. After disposal of the above structure, the housing of the fitness bike comprise is formed by detachably connecting five housings, i.e. the left body housing, the right body housing, the upper cover, the left crank housing, and the right crank housing, making the structure simple, and easy to mount and dismount. The housing structure of the fitness bike is small in volume, compact in structure and small in occupation space. The connection of the housing and the bike body is very stable and reliable, which ensures good sturdiness and durability.

Furthermore, the upper rear portion of the housing structure of the fitness bike is hollowed to form a long through hole for being held by hand. After the disposal of the above structure, the fitness bike can be moved or carried in a short distance and material costs can be saved to some extent.

Furthermore, the rear portion, the top portion, the front portion and the front bottom portion of the housing structure of the fitness bike all have convex arc-shaped surfaces; the left crank housing has a convex arc-shaped surface, the housing of the periphery of the center hole of the left body housing has a convex arc-shaped surface, the right crank housing has a convex arc-shaped surface, and the housing of the periphery of the center hole of the right body housing has a convex arc-shaped surface. After the disposal of the above structure, the top surface of the upper cover has an upwardly convex arc-shaped surface, the front end of the assembled left and right body housings has a forwardly convex arc-shaped surface, the rear end of the assembled left and right body housings has a backwardly convex arc-shaped surface, the front portion of the left crank housing and the left body housing has a leftward convex arc-shaped surface, and the front portion of the right crank housing and the right body housing has a rightward convex arc-shaped surface. The entire external shape is streamlined and the front half is shaped like a drum, which not only greatly increases the entire strength and the durability of the housing structure of the fitness bike but also makes the appearance beautiful. In this case, the exercisers will always have a good psychological experience during exercises.

Furthermore, outer side surfaces of the left body housing and the right body housing have a recessed structure and a reinforcing rib for achieving reinforcement; an inner side of the upper cover has a reinforcing rib for achieving reinforcement; outer side surfaces of the left crank housing and the right crank housing have a recessed structure for achieving reinforcement, and inner side surfaces of the left crank housing and the right crank housing have a reinforcing rib for achieving reinforcement. After disposal of the above structure, the housing structure of the fitness bike will have better strength and better durability.

Furthermore, a stepped round through hole is disposed in the middle portion of the upper cover. A polygonal knob with "-" shaped toggling block in the knob assembly of the resistance adjustment device of the fitness bike is rotatably mated in the stepped round through hole. The bottom end of the knob assembly is connected with an end of wire protruding out of a wire sleeve, the wire sleeve with wire is in an arc shape to connect with the support box of the pedaling device, and the other end of the wire protruding out of wire sleeve is connected with a magnetic resistance sheet. After disposal of the above structure, the fitness bike has a smaller volume and occupies a smaller occupation area. Further, the resistance wire pull distance is shortened, and the wire sleeve is arranged in arc shape, such that the resistance adjustment is more sensitive and the adjustment is more accurate.

BRIEF DESCRIPTIONS OF THE DRAWINGS

Figure 1:
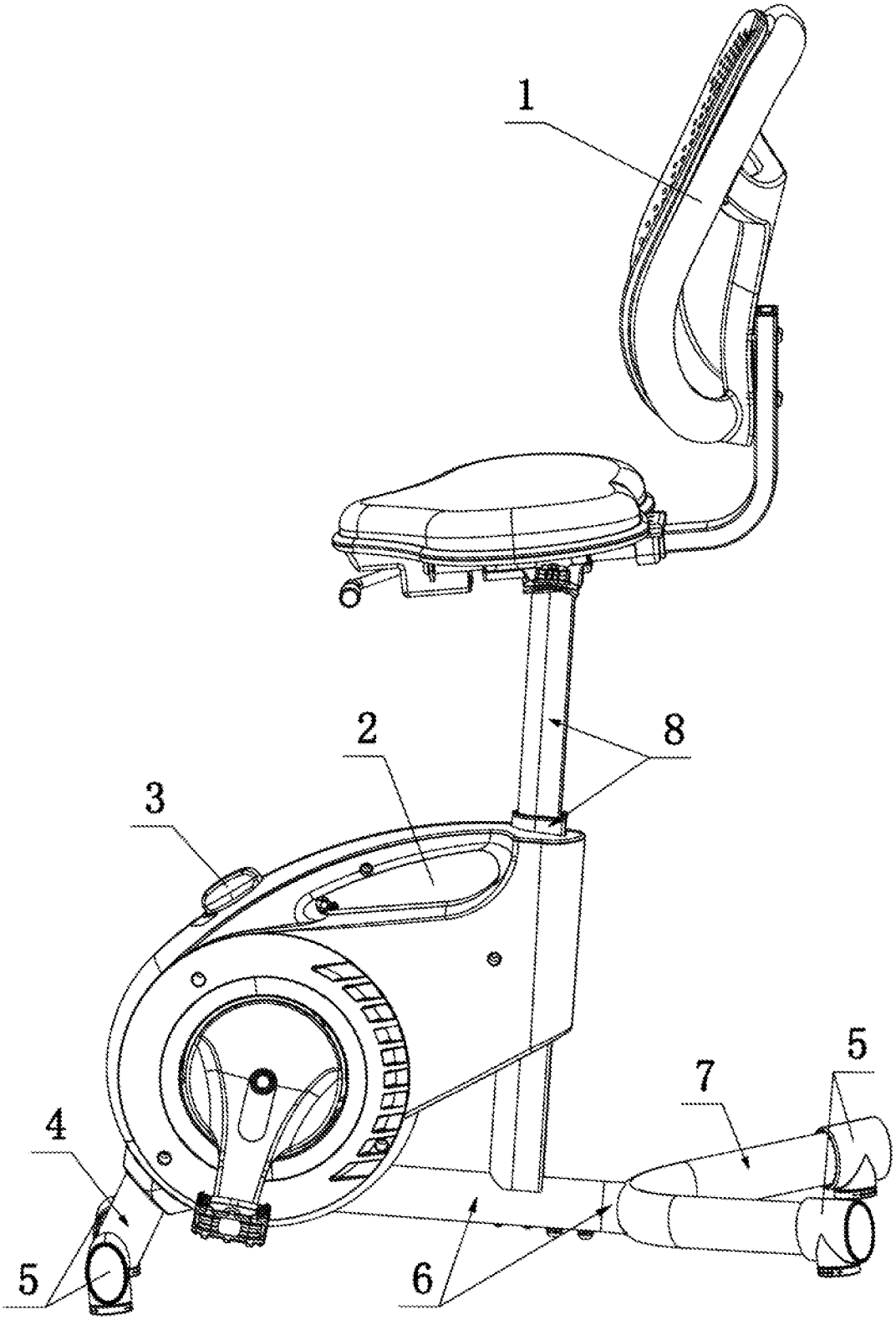
FIG. 1 is a schematic diagram of an entire structure of a fitness bike according to the present invention.

Reference numerals of the drawings are described below: 1. backrest, 2. long through hole, 3. polygonal knob, 4. front support leg, 5. foot pad sleeve, 6. connection rod, 7. V-shaped pipe, 8. seat column, 9. seat support device, 10. rocking handle toggling device, 11. connection block, 12. support box, 13. oblique pipe, 14. connection pipe, 15. wire sleeve, 16. backrest fixing frame, 17. horizontal straight pipe, 18. first thread hole, 19. first screw, 20. first through hole, 21. middle sleeve, 22. axial long groove, 23. slide pipe, 24. third screw, 25. L-shaped gap, 26. sleeve pad, 27. lower sleeve, 28. outer end cover, 29. second screw, 30. second thread hole, 31. inner sleeve, 32. outer sleeve, 33. third thread hole, 34. third through hole, 35. connection rib, 36. central pipe, 37. support block, 38. downwardly-curled edge, 39. toggling shaft mounting base, 40. shaft hole, 41. fixing base, 42. support frame, 43. elongated limiting block, 44. cover plate, 45. seat cushion support plate, 46. locating hole, 47. slide sleeve, 48. connection base, 49. locating column, 50. slide rod, 51. toggling block, 52. locking torsional spring, 53. rocking handle, 54. seat support pipe, 55. toggling assembly, 56. piston rod free end, 57. cylinder, 58. inner pipe, 59. upper cover, 60. reinforcing rib, 61. right body housing, 62. left body housing, 63. left crank housing, 64. right crank housing, 65. recessed structure, 66. stepped surface, 67. bottom 68. first column through hole, 69. stepped round through hole, 70. arc-shaped surface, 71. first oblique pipe hole, 72. second oblique pipe hole, 73. second column through hole, 74. knob assembly, 75. rigid bottom plate, 76. central hole, 77. triangular frame, 78. toggling shaft.

EMBODIMENTS

The specific embodiments of the present invention will be further detailed in combination with the accompanying drawings. It should be noted that the descriptions for these embodiments are intended to help understand the present invention, rather than constitute limitation to the present invention. Further, the technical features in various embodiments of the present invention described below may be mutually combined in a case of no conflict.

Figure 2:
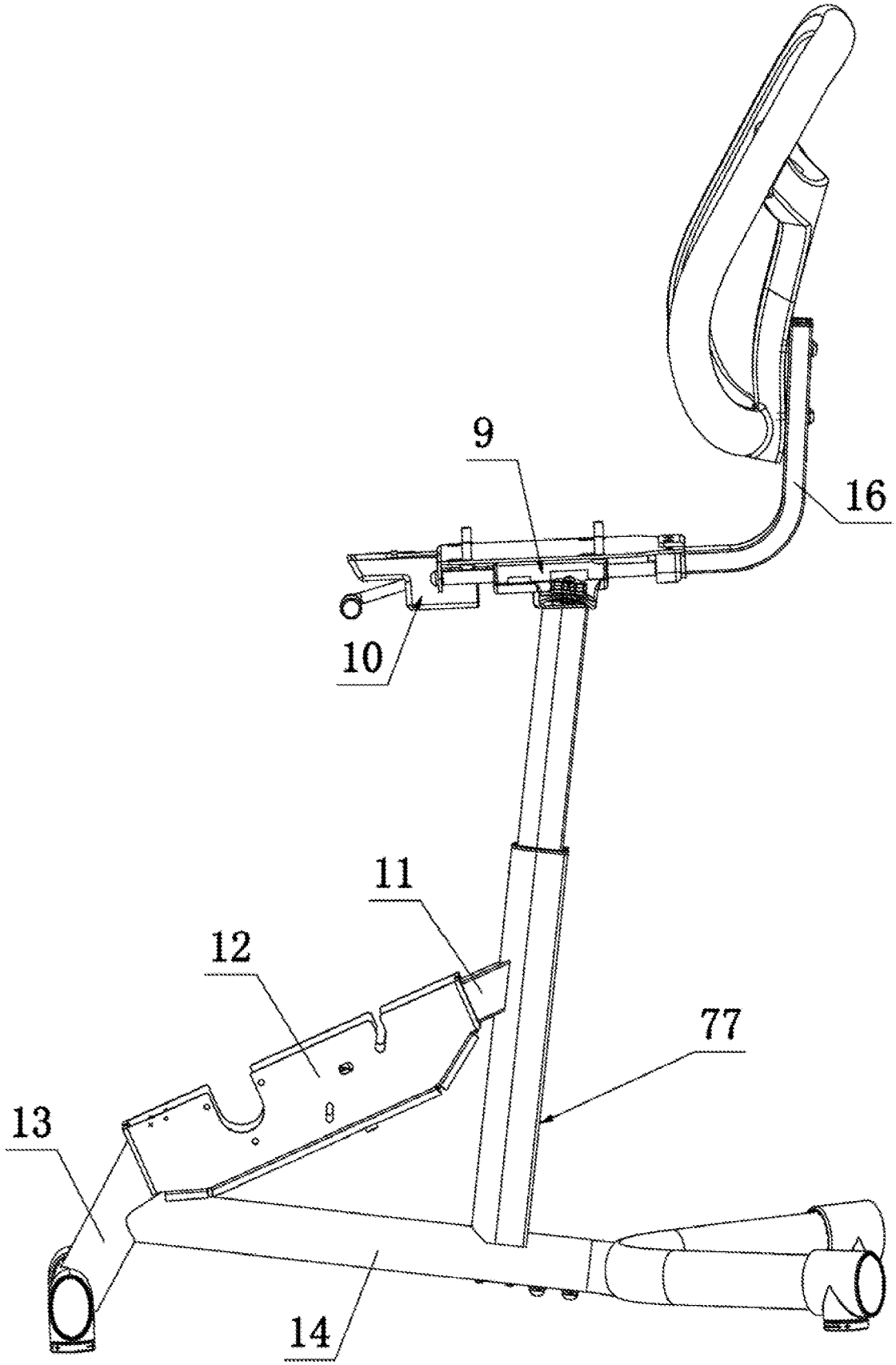
FIG. 2 is a stereoscopic structural schematic diagram 1 of a support skeleton of a fitness bike according to the present invention (front view).
Figure 3:
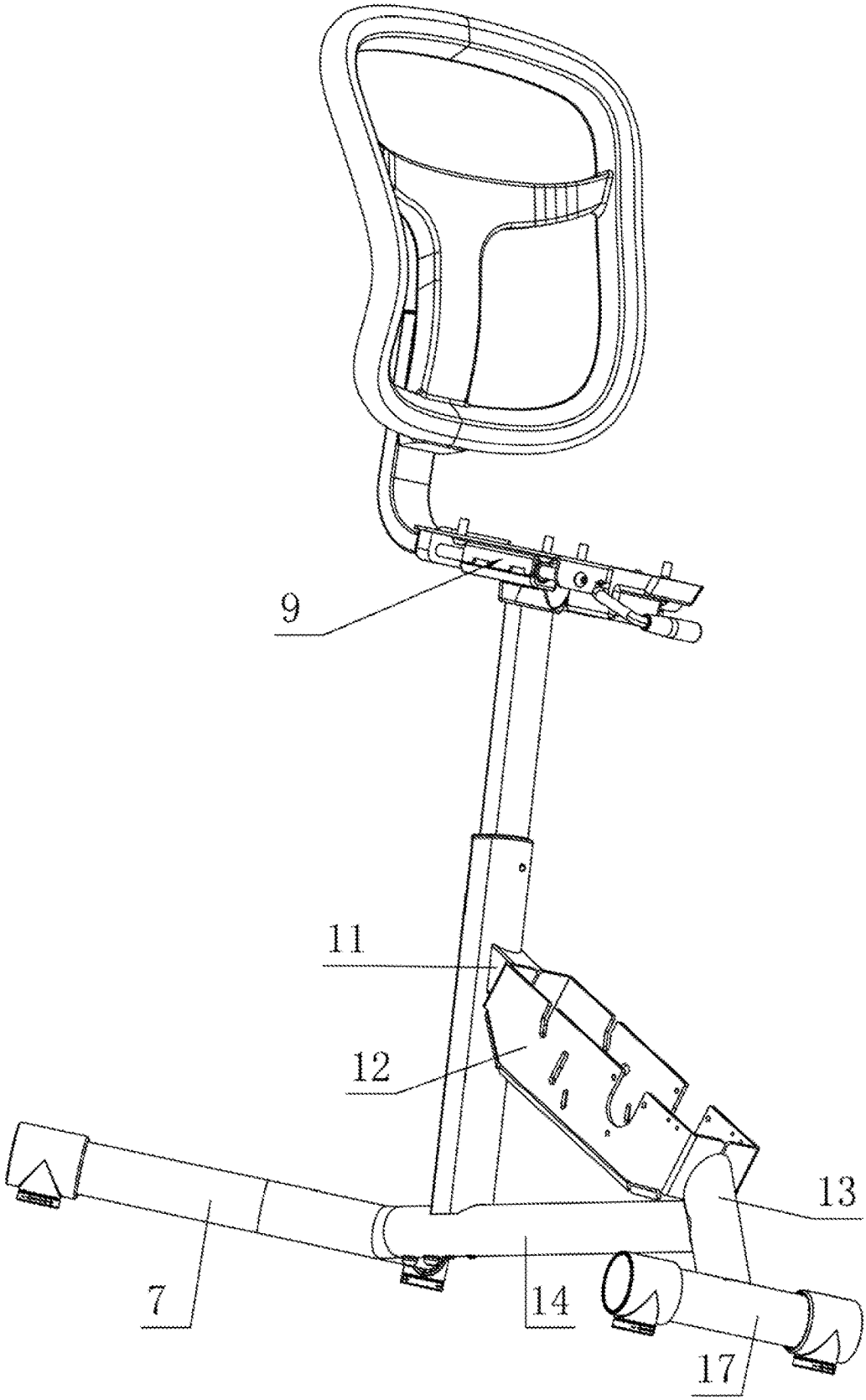
FIG. 3 is a stereoscopic structural schematic diagram 2 of a support skeleton of a fitness bike according to the present invention (front side view).
Figure 4:
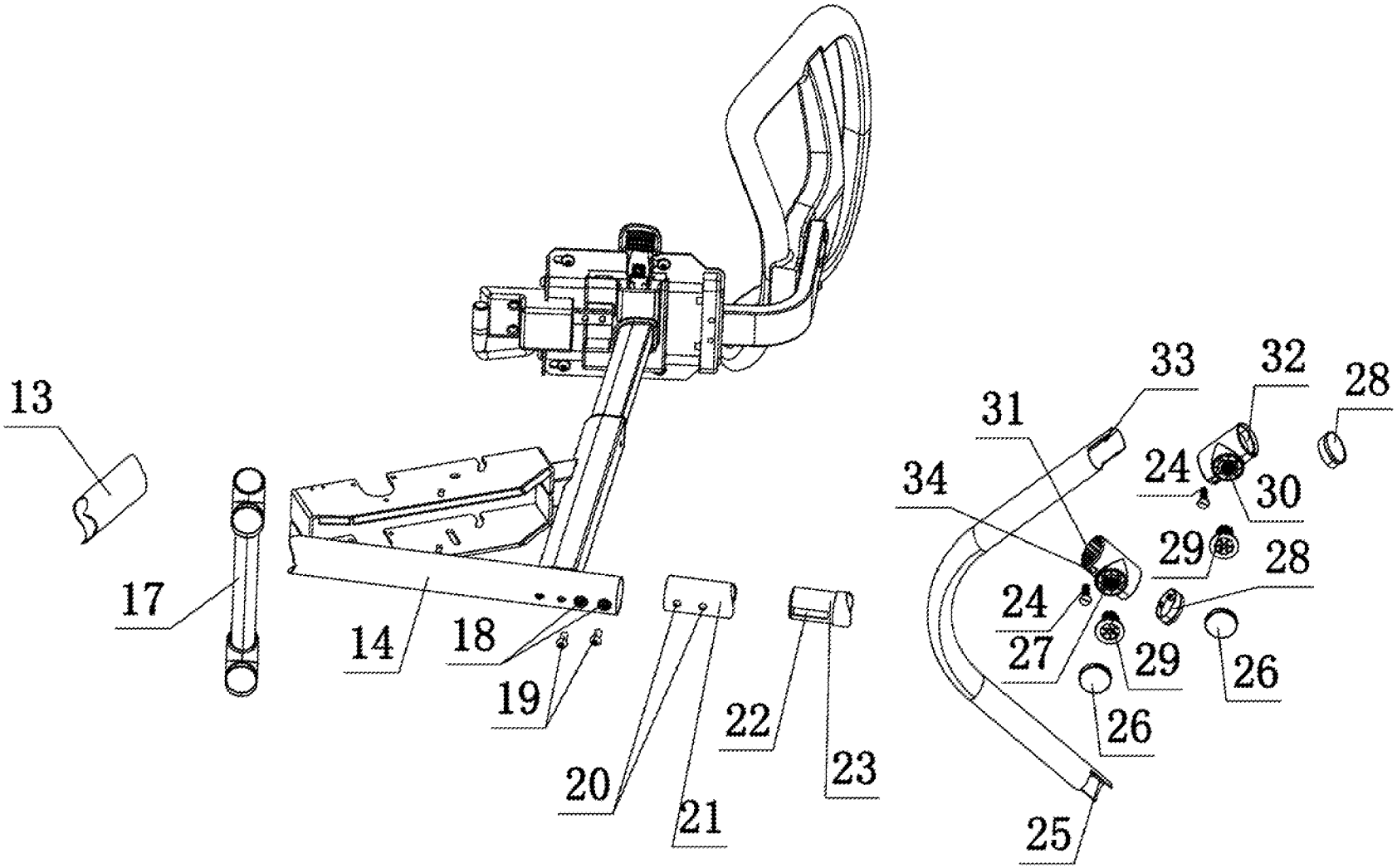
FIG. 4 is an exploded view of a leg-foot structure according to the present invention.
Figure 5:
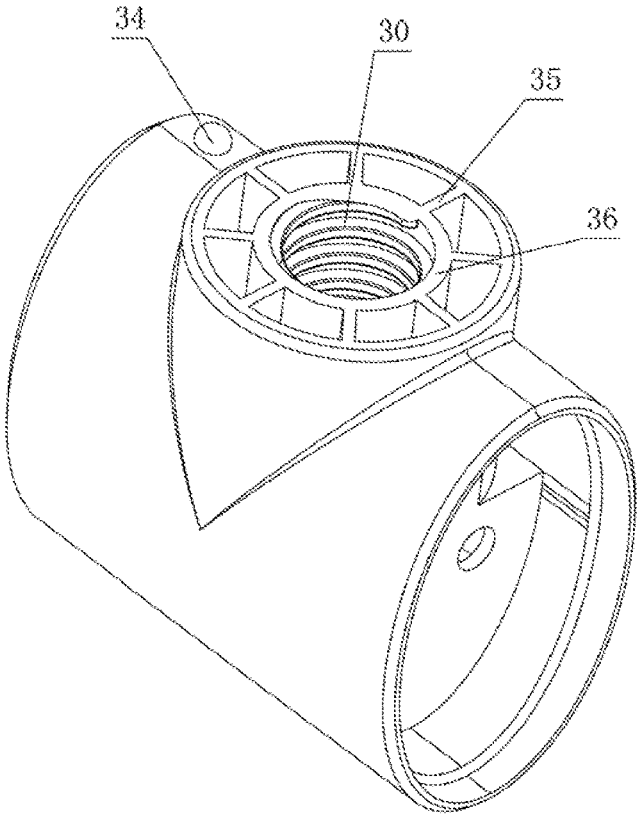
FIG. 5 is a structural schematic diagram of a lower sleeve of a foot pad sleeve in a fitness bike according to the present invention.
Figure 6:
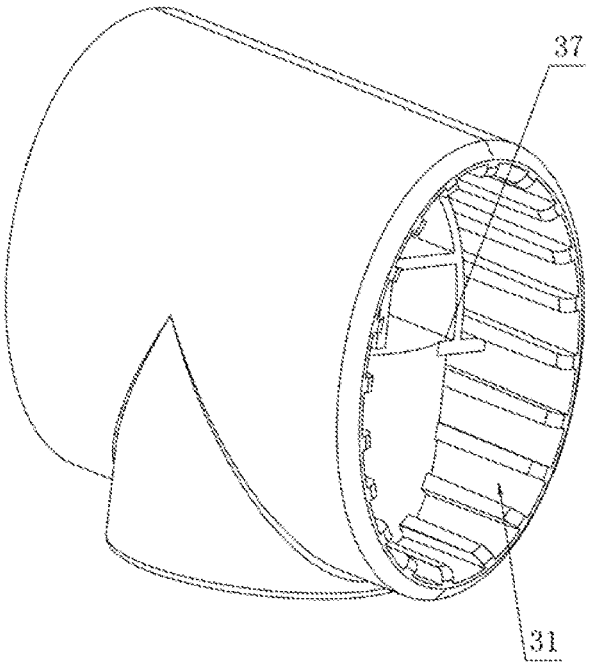
FIG. 6 is a structural schematic diagram of an inner sleeve of a foot pad sleeve in a fitness bike according to the present invention.

As shown in FIGS. 1-6, the fitness bike according to the present invention comprises a support skeleton. The support skeleton comprises a triangular frame 77 which is formed by a connection rod 6 as a transverse rod connecting a front support leg 4 and a rear support leg, an oblique bar of the front support leg, an oblique rod comprising a support box 12 and a connection block 11 of a pedaling device, and a seat column 8 as a vertical rod, which are connected with each other. A lower end of the oblique bar is fixed on a middle of a horizontal rod of the front support leg, a rear end of the connection rod is fixed at a front side of a middle of a V-shaped rod forming the rear support leg and having an opening facing backward, and a seat support device 9 is mounted on the top of the seat column 8.

Furthermore, the horizontal rod and the oblique bar of the front support leg 4, the connection rod, and the V-shaped rod with an opening facing backward are all round pipes: the horizontal rod is a horizontal straight pipe 17, the oblique bar is an oblique pipe 13, the connection rod 6 comprises a connection pipe 14, and the V-shaped rod is a V-shaped pipe 7. An adjustment structure for adjusting a position of the V-shaped pipe 7 relative to the horizontal straight pipe 17 back and forth is disposed on the connection rod 6: a middle sleeve 21 is inserted into a rear end of the connection pipe 14, a slide pipe 23 is inserted into the middle sleeve 21, a plurality of first thread holes 18, for example, two first thread holes, for tightening first screws 19 are disposed at the bottom of the rear end of the connection pipe 14, and a plurality of first through holes 20, for example, two first through holes, for inserting the first screws 19 are disposed at the bottom of the middle sleeve 21; the slide pipe 23 is a stepped pipe with its rear end being a large pipe, a rear end surface of the large pipe is an arc-shaped groove matched in shape with the front side of the middle of the V-shaped pipe 7, a front end of the slide pipe is a small pipe having a front end plate to increase strength, an axial long groove 22 is disposed at the bottom of the small pipe, and a groove top surface of the axial long groove 22 is a plane to be abutted against by the first screws 19.

The support box 12 is formed by two elongated rectangular steel plates disposed symmetrically left and right, both ends of each steel plate are inwardly-curled edges, bottom side is also a curled edge, and both ends of the bottom side are oblique edges from outer upward to inner downward, and the bottom of the oblique edge is also curled edge. The left and right steel plates are assembled to form a rectangular box with upper and lower openings. A plurality of gaps with openings facing upward are disposed on the rectangular box to support a rotary table and a fly wheel. Further, a plurality of long through holes and round through holes for thread-connecting corresponding parts are disposed on the rectangular box. A front end of the rectangular box is a vertical plane which is fixedly connected with an inclined surface of the top of the oblique bar of the front support leg 4 by, for example, welding or strong adhesive bonding. A rear end of the rectangular box is also a vertical plane which is fixedly connected with a vertical plane of a front end of the connection block 11 by, for example, welding or strong adhesive bonding. A rear end surface of the connection block 11 is an arc-shaped surface matched with an outer circumference of a seat support pipe 54 of the seat column 8. The rear end surface of the connection block 11 is fixedly connected with the seat support pipe 54 of the seat column 8 by, for example, welding or strong adhesive bonding. A bottom end surface of the seat support pipe 54 is an arc-shaped surface matched with an outer circumference of the connection pipe 14 of the connection rod 6, and the seat support pipe 54 is fixedly connected with the connection pipe 14 by, for example, welding or strong adhesive bonding. A front end surface of the connection pipe 14 is an arc-shaped surface matched with an outer circumference of the oblique pipe 13, and the front end surface of the connection pipe 14 is fixedly connected with an upper portion of the oblique pipe 13 by, for example, welding or strong adhesive bonding. A bottom end surface of the oblique pipe 13 is an arc-shaped surface matched with an outer circumference of the horizontal straight pipe 17 of the front support leg 4, and the bottom end surface of the oblique pipe 13 is fixedly connected with the horizontal straight pipe 17 by, for example, welding or strong adhesive bonding.

Both ends of the horizontal straight pipe 17 each have one foot pad sleeve 5, and both ends of the V-shaped pipe 7 each have one foot pad sleeve 5. The foot pad sleeve 5 is of three-way structure, one way facing inwardly is an inner sleeve 31 sleeved onto the end of the horizontal straight pipe 17, one way facing outwardly is an outer sleeve 32 into which an outer end cover 28 is sleeved detachably, and one way facing downwardly is a lower sleeve 27 in which a central pipe 36 connected with a plurality of connection ribs 35 is disposed. A second thread hole 30 is disposed in the central pipe 36 and a second screw 29 for adjusting a height is screwed into the second thread hole 30. A sleeve pad 26 for being attached to the ground is fixed on a large head of the second screw 29 by, for example, welding or strong adhesive bonding. The connection ribs 35 are used to connect an inner wall of the lower sleeve 27 with an outer wall of the central pipe 36 and are uniformly distributed circumferentially in a radial manner. In this way, raw materials can be saved and the strength of the lower sleeve 27 can be improved. The second screw 29 is so called for ease of descriptions and may also be called a height adjusting bolt based on supporting force.

The end of the horizontal straight pipe 17 and the V-shaped pipe 7 sleeved with the inner sleeve has a downwardly-facing L-shaped gap 25, a horizontal plane support block 37 for supporting the L-shaped gap 25 is disposed in the inner sleeve 31, that is, a horizontal plane of the support block 37 is used to support the L-shaped gap 25. One third through hole 34 for inserting a third screw 24 is disposed on a bottom wall of the inner sleeve 31, and a third thread hole 33 for screwing the third screw 24 is disposed on the top wall of the L-shaped gap of the horizontal straight pipe 17 and the V-shaped pipe 7.

Figure 7:
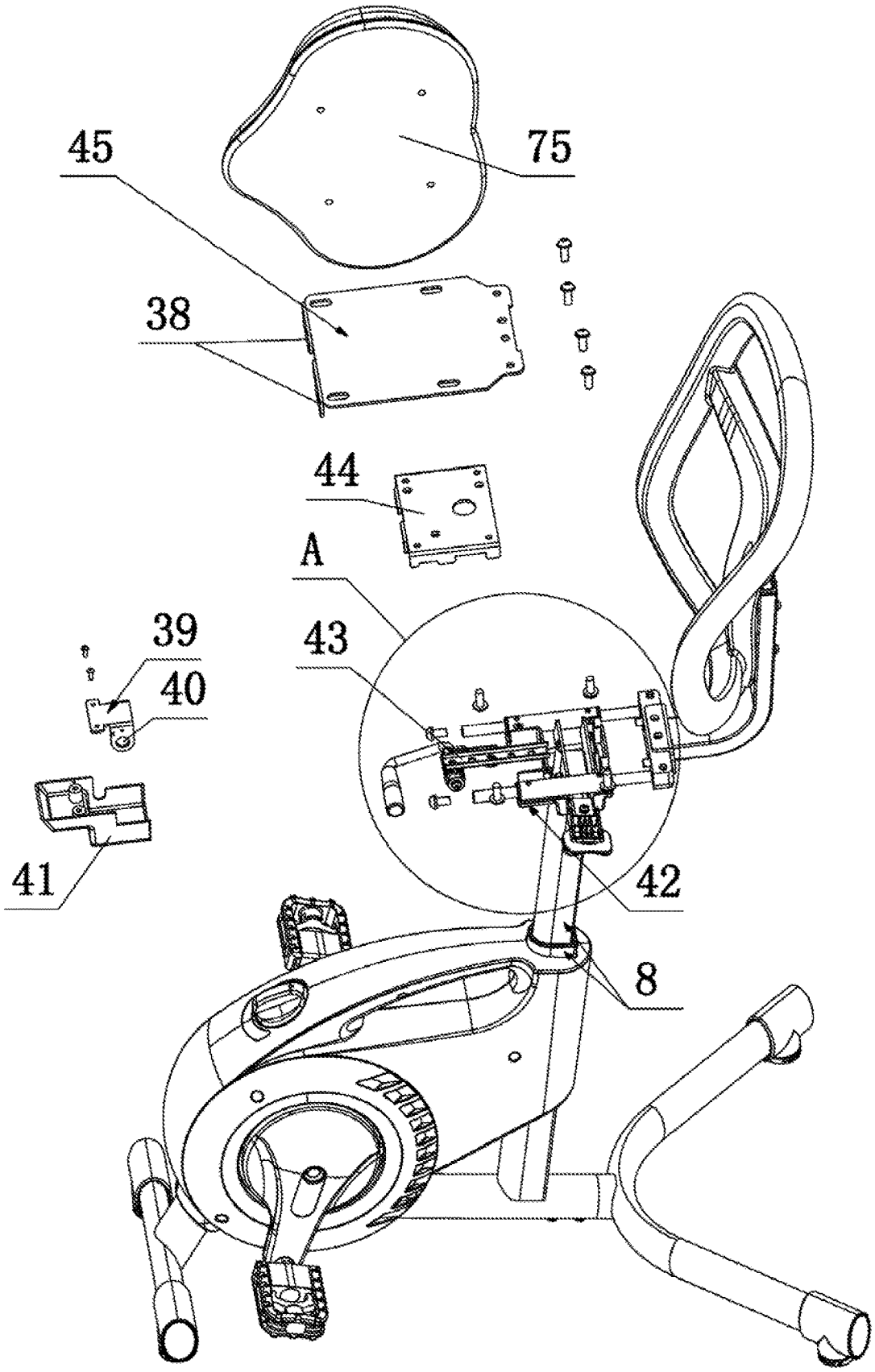
FIG. 7 is an exploded view 1 of a seat support device of a fitness bike according to the present invention.
Figure 8:
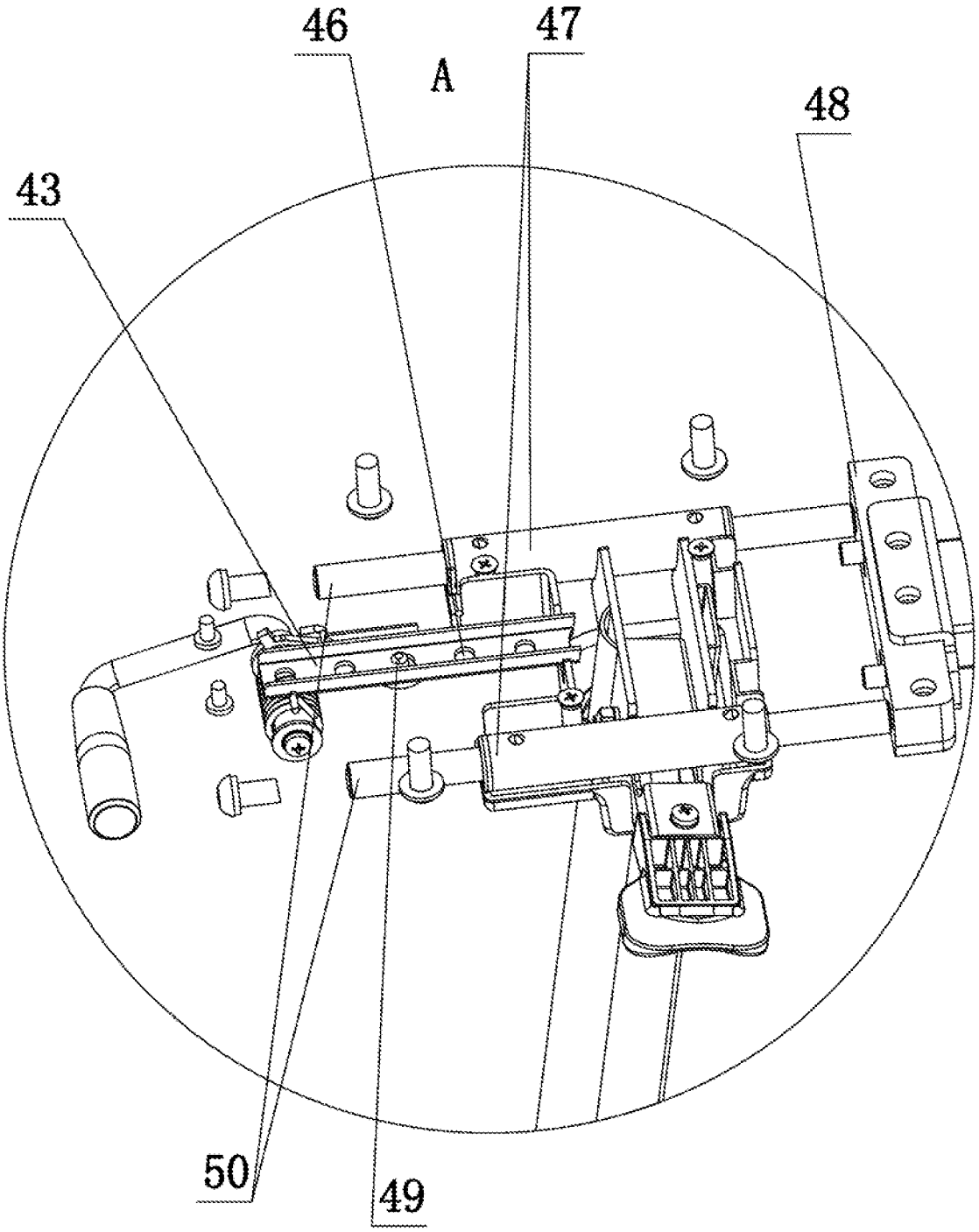
FIG. 8 is an enlarged view of the position A in FIG. 1.
Figure 9:
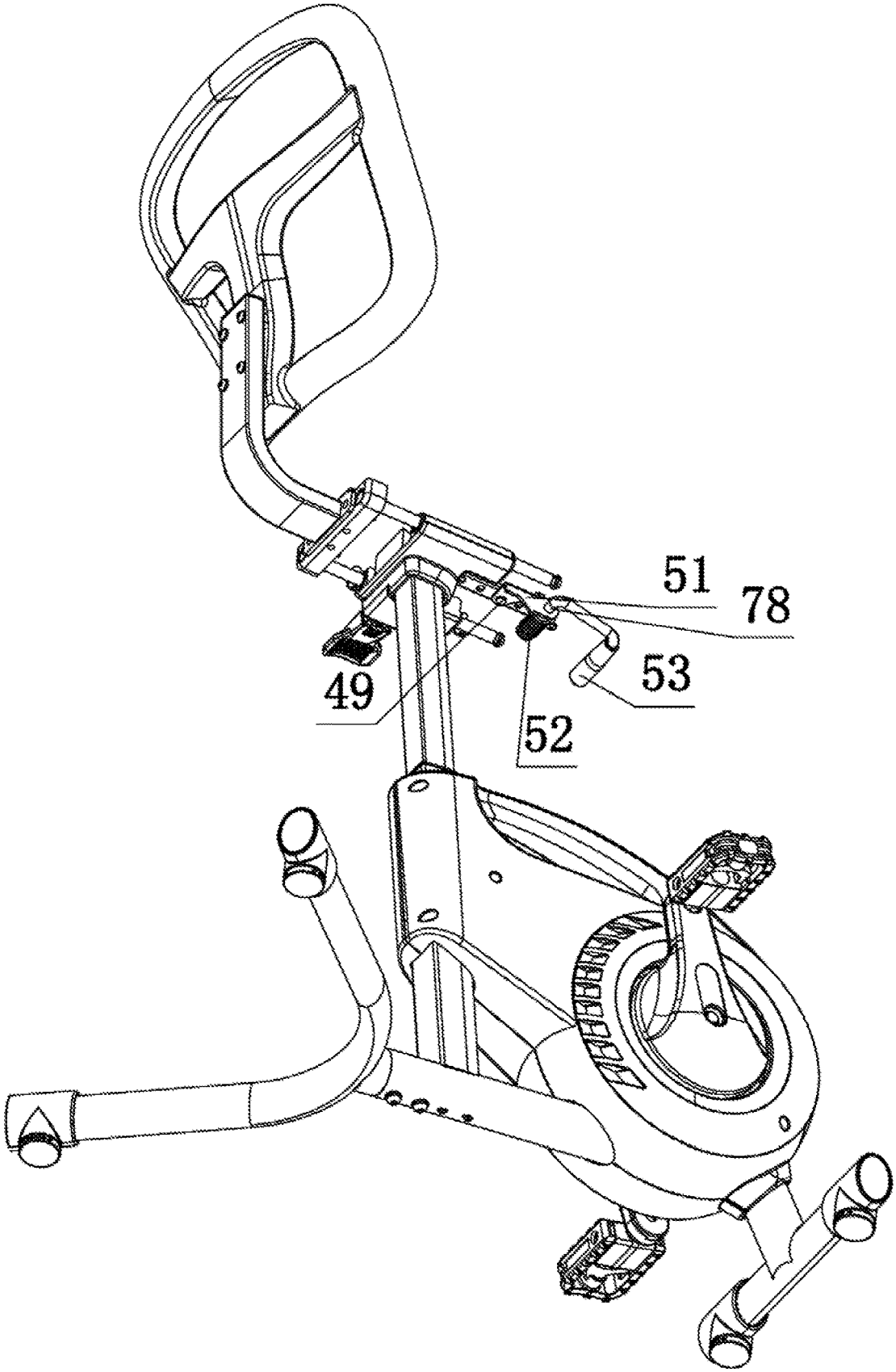
FIG. 9 is a bottom view of a seat support device of a fitness bike according to the present invention.
Figure 10:
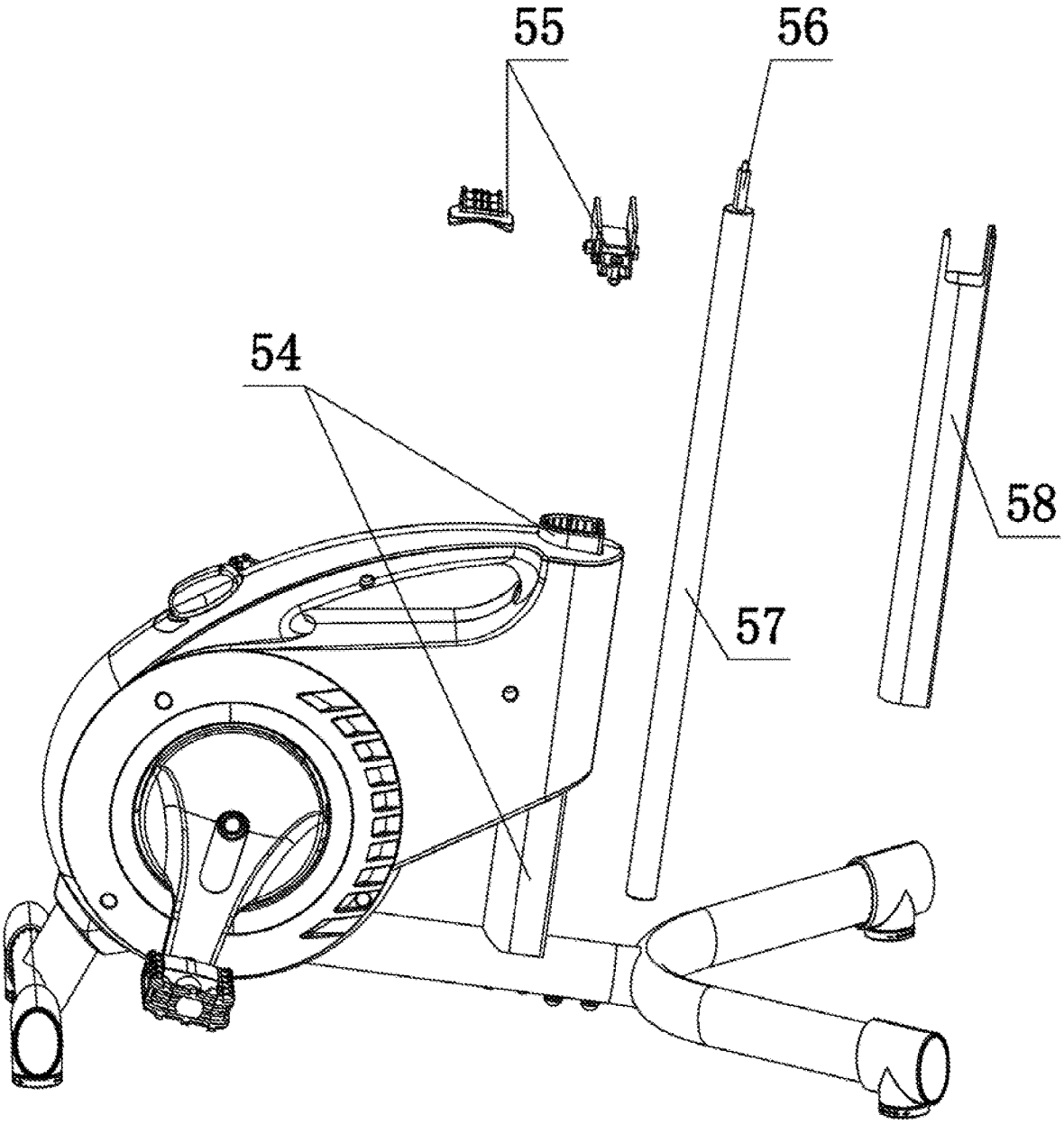
FIG. 10 is an exploded view of a seat lifting structure in a fitness bike according to the present invention.

As shown in FIGS. 1, 7, 8, 9 and 10, the seat support device has the following structure: the top of the seat column 8 is connected with a support frame 42 having two slide sleeves 47, front and rear ends of two slide rods 50 slidably mated in the respective slide sleeves 47 are connected to a seat cushion support plate 45, a rocking handle toggling device 10 is mounted at the front end of the seat cushion support plate 45, a rocking handle of the rocking handle toggling device 10 is used to apply force, a toggling block 51 of the rocking handle toggling device 10 has a locating column 49, an elongated limiting block 43 extending back and forth is disposed on the support frame 42, a plurality of locating holes 46, for example, five locating holes, extending back and force and receiving the locating column 49 are disposed on the elongated limiting block 43, and a locking torsional spring 52 for locking the locating column 49 in one of the plurality of locating holes 46 is disposed on the rocking handle toggling device 10. The support frame 42 comprises a support plate, two slide sleeves fixed in arc-shaped grooves located at left and right sides of the support plate, and a cover plate 44 fixed with the support plate. A "⊏" shaped gap for receiving the extended elongated limiting block 43 is disposed at a front end of the support plate.

A fixing base 41 of the rocking handle toggling device 10 is of stepped shape with its front higher and its rear lower. The top of a rear end of the fixing base 41 has an L-shaped gap attached and fixed to a downwardly-curled edge 38 of the rectangular seat cushion support plate 45 by, for example, welding or strong adhesive bonding. A toggling shaft mounting base 39 is thread-connected to the fixing base 41. For example, there are two thread hole columns with thread holes on the fixing base 41, and screws are inserted correspondingly into through holes of the toggling shaft mounting base 39 and then screwed into the thread holes. A toggling shaft 78 is rotatably inserted through a shaft hole 40 and fixedly connected with the toggling block 51.

The rear ends of the two slide rods 50 have a connection base 48 for connecting with a backrest fixing frame 16 connected with a backrest 1. The seat cushion support plate 45 is rectangular, and a rear side of the seat cushion support plate 45 is thread-connected with the connection base 48. For example, the connection base 48 has a plurality of thread holes and screws are correspondingly inserted through the through holes at the rear side of the seat cushion support plate 45 and screwed into the thread holes. The downwardly-curled edge 38 at the front side of the seat cushion support plate 45 is thread-connected with the front ends of the two slide rods 50. For example, the front-end surfaces of the two slide rods 50 have thread holes, corresponding through holes are disposed on the downwardly-curled edge 38, and two screws are inserted through the respective through holes and screwed into the respective thread holes. The seat cushion support plate 45 is thread-connected with a rigid bottom plate 75 of a seat cushion. For example, both sides of the seat cushion support plate 45 have two through holes respectively, the rigid bottom plate 75 has four thread holes in one-to-one correspondence with the four through holes, and four screws are inserted through the respective through holes and screwed into the respective thread holes.

The seat column 8 is the sole upward column of the fitness bike without a handle device, and the seat column 8 comprises a seat support pipe 54. That is, the fitness bike of the present invention is not provided with a handle or a desk board as a handle, and the seat column 8 is the sole upward column of the fitness bike of the present invention. In this case, the fitness bike can be used as an ordinary chair after the position of the seat is adjusted back and forth and the subsequently-mentioned height is adjusted.

The seat support device 9 further comprises a seat lifting structure: an inner pipe 58 is sleeved slidably into the seat support pipe 54, the top of the inner pipe 58 is connected with the support frame 42, the inner pipe 58 is connected with a piston rod free end 56 of a lockable gas spring located inside the inner pipe 58, a cylinder 57 of the lockable gas spring is placed in the seat support pipe 54 and connected with the seat support pipe 54, and a control valve of the lockable gas spring can be connected to control the lockable gas spring to be released and further lift, or lower or lock up a toggling assembly 55 of the seat mounted on the support frame 42. It can be understood that the lockable gas spring is placed in the inner pipe 58 and the seat support pipe 54, the piston rod free end 56 is placed in the inner pipe 58 and connected with the inner pipe 58, and the cylinder 57 of the lockable gas spring is placed in the seat support pipe 54 and connected with the seat support pipe 54.

Figure 11:
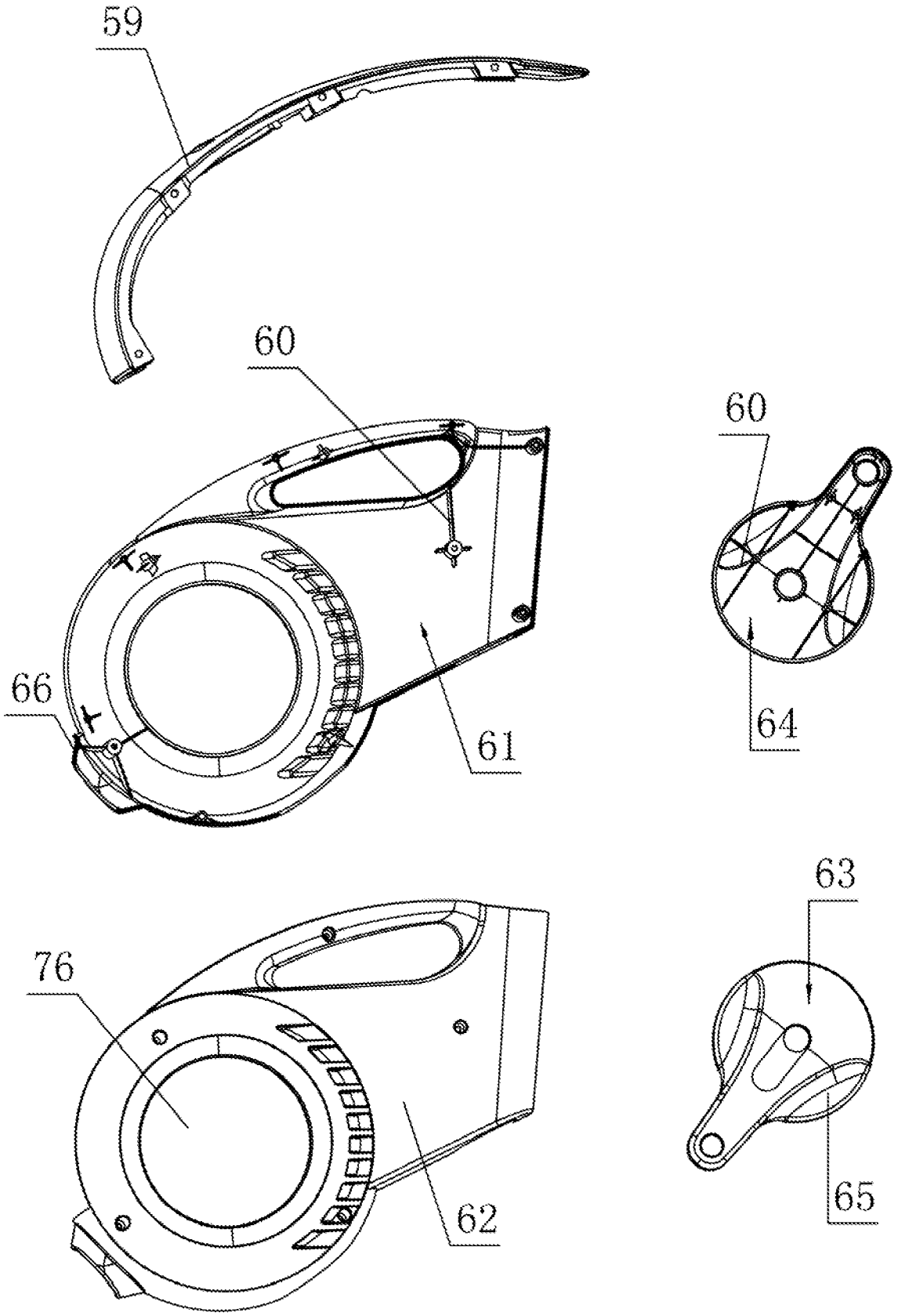
FIG. 11 is an exploded view of a housing structure of a fitness bike according to the present invention.
Figure 12:
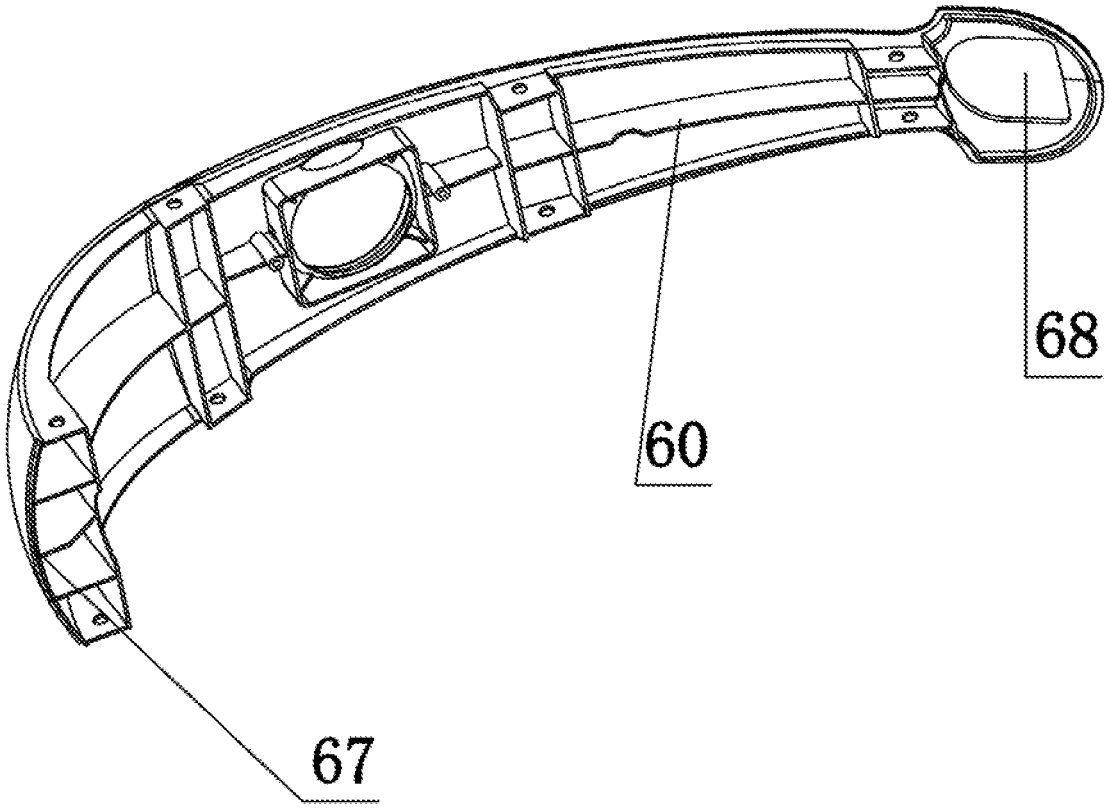
FIG. 12 is a bottom view of an upper cover in a fitness bike according to the present invention.
Figure 13:
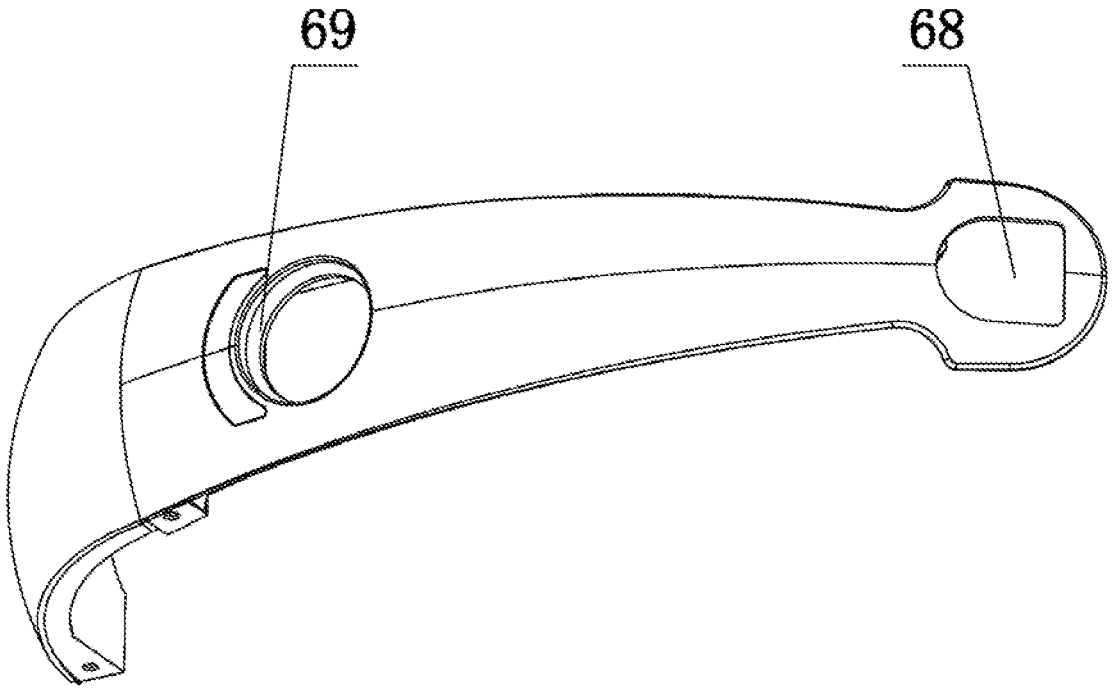
FIG. 13 is a top view of an upper cover in a fitness bike according to the present invention.
Figure 14:
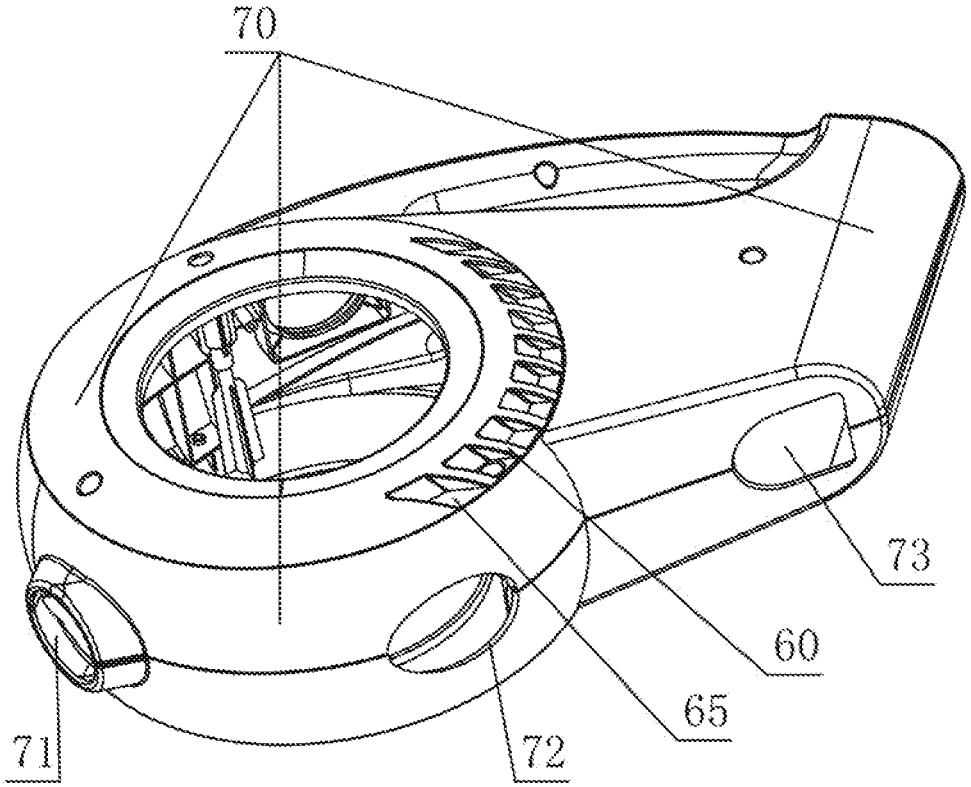
FIG. 14 is a stereoscopic structural schematic diagram of a housing structure of a fitness bike according to the present invention.

As shown in FIGS. 1, 11, 12, 13 and 14, a fitness bike housing structure comprises a left body housing 62, a right body housing 61, an upper cover 59, a left crank housing 63, and a right crank housing 64; rear ends of the left body housing 62 and the right body housing 61 embrace the seat column 8 of the fitness bike, front ends of the left body housing 62 and the right body housing 61 embrace the oblique pipe 13 of the front support leg of the fitness bike, the middle bottoms of the left body housing 62 and the right body housing 61 embrace the connection pipe 14 of the fitness bike, and the left body housing 62 and the right body housing 61 are detachably connected. The seat column 8 is inserted through a first column through hole 68 of a rear end of the upper cover 59, the bottom 67 of the front end of the upper cover 59 is abutted against a stepped surface 66 of a lower portion of a front end of the connected left and right body housings 62, 61, and both sides of the upper cover 59 are detachably connected with the left body housing 62 and the right body housing 61; the crank housing is detachably connected with a connection plate of a crank (not shown) and rotatably mated with a center hole 76 of the body housing. The above will be detailed later.

The left body housing 62 and the right body housing 61 are detachably connected in the following manner: an inner side wall of the left body housing has a plurality of inwardly-protruding thread hole columns with thread holes for screwing screws, an inner side wall of the left body housing has a plurality of through hole columns in one-to-one correspondence with the plurality of thread hole columns, an end surface of the thread hole column is abutted against an end surface of the through hole column, and an outer side wall of the left body housing has a plurality of through holes which axially penetrates through the through hole columns. The inner side wall of the left body housing has a plurality of inwardly-protruding thread hole columns with thread holes for screwing screws, and the inner side wall of the right body housing has a plurality of through hole columns in one-to-one correspondence with the plurality of thread hole columns, and an end surface of the thread hole column is abutted against an end surface of the through hole column. The outer side wall of the right body housing has a plurality of through holes which axially penetrate through the plurality of through hole columns.

Both sides of the upper cover 59 are detachably connected with the left body housing 62 and the right body housing 61 in the following manner: a plurality of fitting columns are disposed on the left body housing and the right body housing, and a plurality of fitting holes into which the plurality of fitting columns are correspondingly inserted are disposed on a left side plate and a right side plate of the upper cover. The fitting columns may be round columns in interference fit with the fitting holes, that is, a diameter of the fitting columns may be slightly larger than a diameter of the fitting holes. The fitting column may also be a radial elastic structure: a free end of the round column is a mushroom-shaped large head, a radial cross opening is disposed on the round column and axially extends to a root of the round column.

The left crank housing and the right crank housing are of same structure and mounted symmetrically, and a detachable connection structure of the left crank housing and the connection plate of the left crank is identical to the detachable connection structure of the right crank housing and the connection plate of the right crank. Therefore, for ease of descriptions, the left connection plate of the crank and the right connection plate of the crank refer to the same connection plate. The crank housing is detachably connected with the crank connection plate and mated rotatably with the center hole of the body housing as follows: a snap-fit structure is disposed on the inner sides of the left crank housing the right crank housing respectively, the inner sides of the left crank housing the right crank housing have a plurality of thread hole columns with thread holes for screwing screws respectively, and the left connection plate and the right connection plate of the crank have a plurality of through holes in one-to-one correspondence with the plurality of thread holes respectively.

It can be understood that the above embracement refers to that a semicircular hole is reserved on each of the bottom plates of the left body housing 62 and the right body housing 61, such that a second column through hole 73, a first oblique pipe hole 71, and a second pipe oblique hole 72 can be formed after the housings are assembled. That is, there will be the second column through hole 73, the first oblique pipe hole 71 and the second oblique pipe hole 72 on the bottom plate of the connected left and right body housings 62 and 61.

The upper rear portion of the housing structure of the fitness bike is hollowed to form a long through hole 2 for being held by hand.

The rear portion, the top portion, the front portion and the front bottom portion of the housing structure of the fitness bike all have convex arc-shaped surfaces 70; the left crank housing 63 has a convex arc-shaped surface 70, the housing of the periphery of the center hole of the left body housing has a convex arc-shaped surface 70, the right crank housing 64 has a convex arc-shaped surface 70, and the housing of the periphery of the center hole of the right body housing has a convex arc-shaped surface 70.

Outer side surfaces of the left body housing 62 and the right body housing 61 have a recessed structure 65 and a reinforcing rib 60 for achieving reinforcement; an inner side of the upper cover 59 has a reinforcing rib 60 for achieving reinforcement; outer side surfaces of the left crank housing 63 and the right crank housing 64 have a recessed structure 65 for achieving reinforcement, and inner side surfaces of the left crank housing 63 and the right crank housing 64 have a reinforcing rib 60 for achieving reinforcement.

Figure 15:
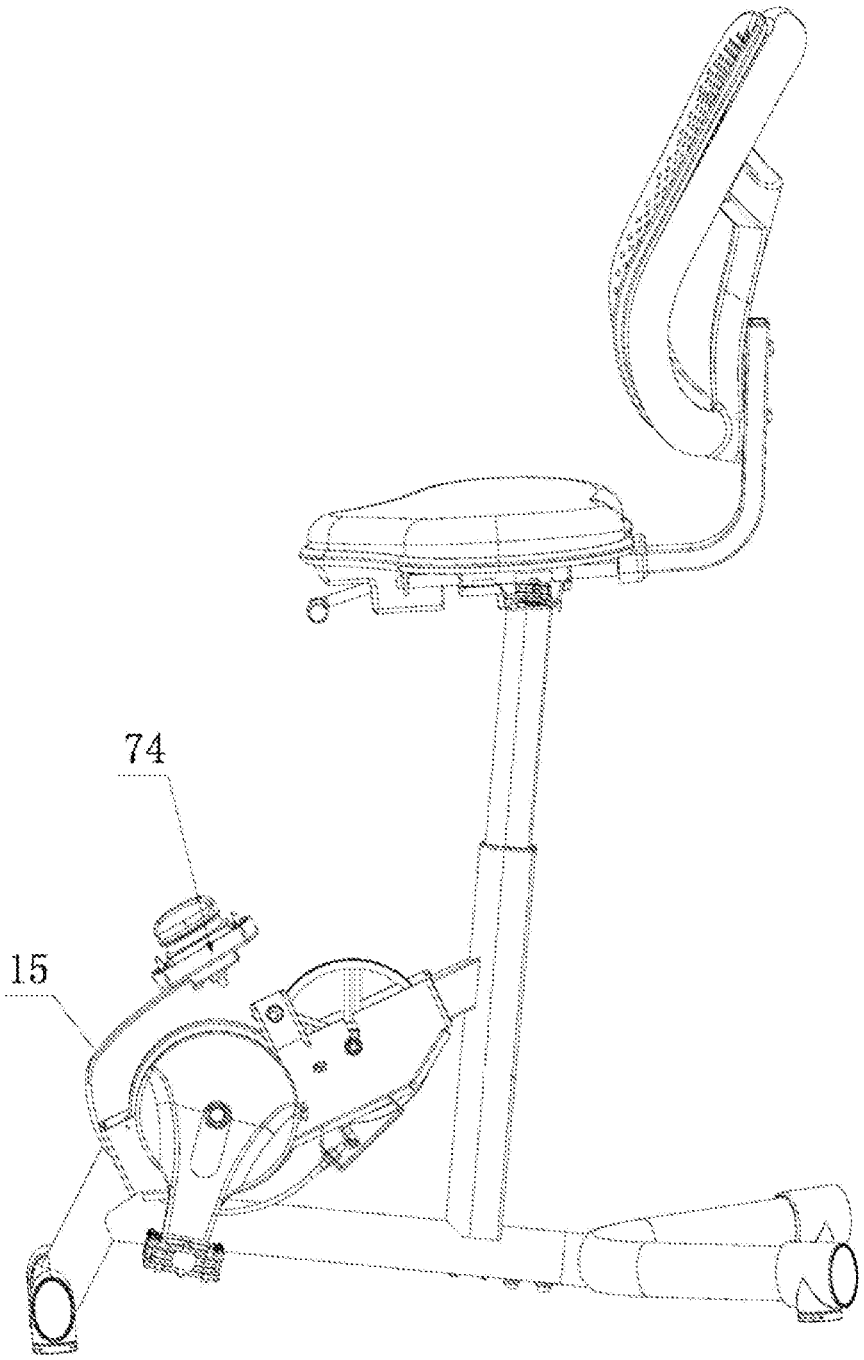
FIG. 15 is a schematic diagram of a connection structure of a resistance adjustment structure in a fitness bike according to the present invention.

As shown in FIGS. 1, 11, 13, and 15, a stepped round through hole 69 is disposed in the middle portion of the upper cover 59. A polygonal knob 3 with "-" shaped toggling block in the knob assembly 74 of the resistance adjustment device of the fitness bike is rotatably mated in the stepped round through hole. The bottom end of the knob assembly 74 is connected with an end of wire protruding out of a wire sleeve 15, the wire sleeve 15 with wire is in an arc shape to connect with the support box 12 of the pedaling device, and the other end of the wire protruding out of wire sleeve is connected with a magnetic resistance sheet. For example, a plurality of magnetic resistance sheets are sequentially arranged on one elongated support block, one end of the support block is fixed on the support box 12, and the other end of the wire protruding out of the wire sleeve is connected with an adjustment end of the support block.

The seat column is also called a seat column support or seat plate column or seat plate column support.

The above descriptions are merely made to the preferred embodiments of the present invention and shall not be intended to limited to the present invention. Those skilled in the part may make various changes or variations to the present invention. Any modifications, equivalent substitutions and improvements and the like made within the spirit and principle of the present invention shall all fall within the scope of protection of the present invention.

The invention claimed is:

1. A fitness bike, comprising a support skeleton wherein the support skeleton comprises a triangular frame, and the triangular frame is formed by a connection rod as transversely connecting a front support leg and a rear support leg; an oblique bar of the front support leg, a support box and a connection block of a pedaling device, and a seat column that is positioned vertically, the connection block providing a spaced connection between the support box and the seat column; a lower end of the oblique bar is fixed on a middle of a horizontal rod of the front support leg, a rear end of the connection rod is fixed at a front side of a middle of a V-shaped rod forming the rear support leg and having an opening facing backward, and a seat support device is mounted on a top of the seat column.

2. The fitness bike of claim 1, wherein the horizontal rod and the oblique bar of the front support leg, the connection rod, and the V-shaped rod with the opening facing backward are all round pipes: the horizontal rod is a horizontal straight pipe, the oblique bar is an oblique pipe, the connection rod comprises a connection pipe, and the V-shaped rod is a V-shaped pipe; an adjustment structure for adjusting a position of the V-shaped pipe relative to the horizontal straight pipe back and forth is disposed on the connection rod: a middle sleeve is inserted into a rear end of the connection pipe, a slide pipe is inserted into the middle sleeve, a plurality of first thread holes for tightening first screws are disposed at the bottom of the rear end of the connection pipe, and a plurality of first through holes for inserting the first screws are disposed at the bottom of the middle sleeve; the slide pipe is a stepped pipe with its rear end being a large pipe, a rear end surface of the large pipe is an arc-shaped groove matched in shape with the front side of the middle of the V-shaped pipe, a front end of the slide pipe is a small pipe having a front end plate, an axial long groove is disposed at the bottom of the small pipe, and a groove top surface of the axial long groove is a plane to be abutted against by the first screws.

3. The fitness bike of claim 2, wherein both ends of the horizontal straight pipe each have one foot pad sleeve, and both ends of the V-shaped pipe each have one foot pad sleeve; the foot pad sleeve comprising: a side facing toward the fitness bike that is an inner sleeve sleeved onto the end of the horizontal straight pipe, a side facing away from the fitness bike that is an outer sleeve into which an outer end cover is sleeved detachably, and a side facing downwards that is a lower sleeve in which a central pipe connected with a plurality of connection ribs is disposed; a second thread hole is disposed in the central pipe and a second screw for adjusting a height is screwed into the second thread hole; a sleeve pad for being attached to the ground is fixed on a large head of the second screw.

4. The fitness bike of claim 3, wherein each the end of the horizontal straight pipe and the V-shaped pipe sleeved with the inner sleeve has a downwardly-facing L-shaped gap, a horizontal plane support block for supporting the L-shaped gap is disposed in the inner sleeve, a third through hole for inserting a third screw is disposed on a bottom wall of the inner sleeve, and a third thread hole for screwing the third screw is disposed on a top wall of the L-shaped gap of the horizontal straight pipe and the V-shaped pipe.

5. The fitness bike of claim 1, wherein the seat support device comprises: the top of the seat column is connected with a support frame having two slide sleeves, front and rear ends of two slide rods slidably mated in the respective slide sleeves are connected to a seat cushion support plate, a rocking handle toggling device is mounted at the front end of the seat cushion support plate, a toggling block of the rocking handle toggling device has a locating column, an elongated limiting block extending back and forth is disposed on the support frame, a plurality of locating holes extending back and forth and receiving the locating column are disposed on the elongated limiting block, and a locking torsional spring for locking the locating column in one locating hole is disposed on the rocking handle toggling device.

6. The fitness bike of claim 5, wherein the rear ends of the two slide rods have a connection base for connecting with a backrest fixing frame, and a backrest is connected with to the backrest fixing frame; the seat cushion support plate is rectangular, and a rear side of the seat cushion support plate is thread-connected with the connection base; a downwardly-curled edge at a front side of the seat cushion support plate is thread-connected with the front ends of the two slide rods; the seat cushion support plate is thread-connected with a rigid bottom plate of a seat cushion.

7. The fitness bike of claim 6, wherein the seat column is the sole upward column of the fitness bike without a handle device, and the seat column comprises a seat support pipe; the seat support device further comprises a seat lifting structure: an inner pipe is sleeved slidably into the seat support pipe, a top of the inner pipe is connected with the support frame, the inner pipe is connected with a piston rod free end of a lockable gas spring located inside the inner pipe, a cylinder of the lockable gas spring is placed in the seat support pipe and connected with the seat support pipe, and a control valve of the lockable gas spring can be connected to control the lockable gas spring to be released and further lift, lower or lock up a toggling assembly of the seat mounted on the support frame.

8. The fitness bike of claim 1, wherein a fitness bike housing structure comprises a left body housing, a right body housing, an upper cover, a left crank housing, and a right crank housing; rear ends of the left body housing and the right body housing embrace the seat column of the fitness bike, front ends of the left body housing and the right body housing embrace the oblique pipe of the front support leg of the fitness bike, a bottom center of the left body housing and the right body housing embrace the connection pipe of the fitness bike, and the left body housing and the right body housing are detachably connected; the seat column is inserted through a first column through hole of a rear end of the upper cover, a bottom of a front end of the upper cover is abutted against a stepped surface of a lower portion of a front end of the connected left and right body housings, and both sides of the upper cover are detachably connected with the left body housing and the right body housing; the crank housing is detachably connected with a connection plate of a crank and rotatably mated with a center hole of the body housing.

9. The fitness bike of claim 8, wherein an upper rear portion of the housing structure of the fitness bike is hollowed to form a long through hole configured to be held by a hand of a user.

10. The fitness bike of claim 8, wherein the rear portion, the top portion, the front portion and the front bottom portion of the housing structure of the fitness bike all have convex arc-shaped surfaces; the left crank housing has a convex arc-shaped surface, the housing of the periphery of the center hole of the left body housing has a convex arc-shaped surface, the right crank housing has a convex arc-shaped surface, and the housing of the periphery of the center hole of the right body housing has a convex arc-shaped surface.

11. The fitness bike of claim 10, wherein outer side surfaces of the left body housing and the right body housing have a recessed structure and a reinforcing rib for achieving reinforcement; an inner side of the upper cover has a reinforcing rib for achieving reinforcement; outer side surfaces of the left crank housing and the right crank housing have a recessed structure for achieving reinforcement, and inner side surfaces of the left crank housing and the right crank housing have a reinforcing rib for achieving reinforcement.

12. The fitness bike of claim 8, wherein a stepped round through hole is disposed in the middle portion of the upper cover; polygonal knob with a line shaped toggling block in the knob assembly of the resistance adjustment device of the fitness bike is rotatably mated in the stepped round through hole; a bottom end of the knob assembly is connected with an end of wire protruding out of a wire sleeve, the wire sleeve with wire is in an arc shape to connect with the support box of the pedaling device.

* * * * *